US008367287B2

(12) United States Patent
Sugimura et al.

(10) Patent No.: US 8,367,287 B2
(45) Date of Patent: Feb. 5, 2013

(54) ELECTROPHOTOGRAPHIC PHOTOCONDUCTOR, METHOD OF PRODUCING THE SAME AND IMAGE FORMING APPARATUS

(75) Inventors: Hiroshi Sugimura, Habikino (JP); Kotaro Fukushima, Kawanishi (JP); Koichi Toriyama, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 1783 days.

(21) Appl. No.: 11/642,635

(22) Filed: Dec. 21, 2006

(65) Prior Publication Data

US 2007/0160921 A1 Jul. 12, 2007

(30) Foreign Application Priority Data

Jan. 12, 2006 (JP) ..... 2006-005018

(51) Int. Cl.
*G03G 5/14* (2006.01)

(52) U.S. Cl. ..... 430/66; 430/67; 430/132; 399/159

(58) Field of Classification Search ..... 430/66, 430/67, 132; 399/159
See application file for complete search history.

(56) References Cited

U.S. PATENT DOCUMENTS

| | | | | |
|---|---|---|---|---|
| 4,260,671 | A | 4/1981 | Merrill | |
| 4,321,118 | A * | 3/1982 | Felder et al. | 522/36 |
| 5,391,449 | A * | 2/1995 | Maruyama et al. | 430/66 |
| 2005/0266327 | A1 * | 12/2005 | Toriyama et al. | 430/58.35 |

FOREIGN PATENT DOCUMENTS

| | | | |
|---|---|---|---|
| JP | 4-260051 | | 9/1992 |
| JP | 8-184980 | A | 7/1996 |
| JP | 8-234470 | A | 9/1996 |
| JP | 10-158380 | | 11/2001 |
| JP | 2005-338271 | | 12/2005 |

OTHER PUBLICATIONS

Borsenberger, Paul M. et al. Organic Photoreceptors for Imaging Systems. New York: Marcel-Dekker, Inc. (1993) pp. 289-297.*
Itami et al., Development of High Durable Organic Photoreceptor, Mega OPC, Konika Technical Report, vol. 14, pp. 43-46 (2001).

* cited by examiner

*Primary Examiner* — Christopher Rodee
(74) *Attorney, Agent, or Firm* — Nixon & Vanderhye P.C.

(57) ABSTRACT

An electrophotographic photoconductor of the invention comprising: an conductive support; a light-sensitive layer formed on the conductive support and containing a charge generating material and a charge transport material; and a surface protective layer formed on the light-sensitive layer and made of a resin composition, wherein the resin composition constituting the surface protective layer contains an amine compound represented by the following formula (1):

(1)

wherein R1 and R2 are, the same or different, each an alkyl group or an allyl group which may have a substituent or a heterocyclic residue to be formed through or not through a nitrogen atom or an oxygen atom together with the nitrogen atom to which R1 and R2 are bonded, R3 and R4 are, the same or different, each an alkyl group having a substituent and n denotes 1 or 2, provided that when n is 1, X is a hydrogen atom, a halogen atom, or an alkyl group, a hydroxyl group or a mercapto group which may have a substituent, or a ring optionally containing an oxygen atom and a nitrogen atom between carbon atoms and when n is 2, X is an oxygen atom or a sulfur atom.

8 Claims, 3 Drawing Sheets

ELECTROPHOTOGRAPHIC PHOTOCONDUCTOR, METHOD OF PRODUCING THE SAME AND IMAGE FORMING APPARATUS

CROSS-REFERENCE TO RELATED APPLICATION

This application is related to Japanese patent application No. 2006-005018 filed on Jan. 12, 2006 whose priority is claimed under 35 USC §119, the disclosure of which is incorporated by reference in its entirety.

BACKGROUND OF THE INVENTION

1. Field of the Invention

The invention relates to an electrophotographic photoconductor to be used for image formation by an electrophotographic system, a method of producing the electrophotographic photoconductor and an image forming apparatus using the electrophotographic-photoconductor.

2. Description of the Related Art

Electrophotographic photoconductors which are used to form an image in an electrophotographic system and exposed to light corresponding to image information to thereby form an electrostatic latent image are used in image forming apparatuses. These image forming apparatuses provided with this electrophotographic photoconductor are widely utilized not only in copying machines but also in printers as output means used in, for example, computers for which there has been a significantly increased demand in recent years.

Generally, the electrophotographic photoconductor is formed by applying an organic light-sensitive layer to the outside peripheral surface of a hollow and cylindrical conductive support (base member) made of an conductive material. In many current electrophotographic photoconductors, the light-sensitive layer is designed to have a laminate structure in which an undercoat layer, a charge generation layer and a charge transport layer are applied and laminated in this order on a conductive support, to bring out a higher performance. Furthermore, there has been a proposal to improve the mechanical durability of an electrophotographic photoconductor by applying a surface protective layer as the outermost layer of a light-sensitive layer.

For a material of this surface protective layer, there are a proposal using a polycarbonate resin having a polar group (see, for example, Specification of U.S. Pat. No. 4,260,671) and a proposal using a polycarbonate resin having a fluorine-substituted alkyl group (see, for example, Publication of Japanese Patent No. 3246362).

Moreover, as the surface protective layer, one obtained by using a three-dimensional crosslinking siloxane resin is proposed (see, for example, ITAMI, SAKIMURA, OSHIBA and WATANABE, "Development of ultra-durable photoconductor (Mega OPC)", KONIKA TECHNICAL REPORT, Konica Corporation, 2001, Vol. 14, p 43-46). When this surface protective layer is formed, a coating solution produced in a small amount is used only once to apply it by slide hopper system coating because the coating solution itself has reactivity and is short-lived. Also, in this method, a charge transport material having a specific molecular structure is used because usual charge transport materials used for a charge transport layer have the problem concerning solubility in an alcohol solvent and the formation of a uniform coating film.

As a method of forming the surface protective layer, a method is generally used in which a coating solution prepared by dissolving a resin and other components in a solvent is applied to a light-sensitive layer by a dip coating method, a roll coating method, spraying method, slide hopper method or ink jet method and the solvent is vaporized by hot air drying, natural drying or the like.

However, higher durability is required for current electrophotographic photoconductors to improve the durability of a machine body and process speed and for the adoption of a contact charge system and the current surface protective layer constituted of a resin dispersion film have come to be in the situation where it cannot cope with the requirement.

Therefore, in the method described in ITAMI et al., it is intended to improve the durability of the surface protective layer by applying a siloxane type monomer component which is a material for forming the surface protective layer and then by thermally curing the monomer component to form the surface protective layer having a firm three-dimensional crosslinking structure.

However, as a result of the studies made by the inventors of the present invention, it has been found that the method described in ITAMI et al., in which an initiator that polymerizes a monomer component is used in the formation of the surface protective layer, this initiator reaches a trap level when it remains in the surface protective layer and has an adverse influence on the electric properties of the layer. Some ideas occur, which include an idea that the amount of the initiator to be used is reduced and an idea that an additive that stabilizes potential characteristics is added. However, it has been also found that these measures reduce the strength of the film.

The inventors of the present invention have found that a specific amine compound is an effective compound as an initiator and also has the effect of stabilizing electric characteristics, and proposed in the previous patent application (Publication of JP-A No. 2005-338271) that this amine compound is used not as an initiator but as an additive in a light-sensitive layer.

SUMMARY OF THE INVENTION

According to a first aspect of the present invention, there is provided an electrophotographic photoconductor comprising: an conductive support; a light-sensitive layer formed on the conductive support and containing a charge generating material and a charge transport material; and a surface protective layer formed on the light-sensitive layer and made of a resin composition, wherein the resin composition constituting the surface protective layer contains an amine compound represented by the following formula (1):

(1)

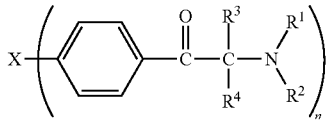

wherein R1 and R2 are, the same or different, each an alkyl group or an allyl group which may have a substituent or a heterocyclic residue to be formed through or not through a nitrogen atom or an oxygen atom together with the nitrogen atom to which R1 and R2 are bonded, R3 and R4 are, the same or different, each an alkyl group having a substituent and n denotes 1 or 2, provided that when n is 1, X is a hydrogen atom, a halogen atom, or an alkyl, hydroxyl or mercapto group which may have a substituent, or a ring optionally containing an oxygen atom or a nitrogen atom between carbon atoms and when n is 2, X is an oxygen atom or a sulfur atom.

According to another aspect of the present invention, there is provided an image forming apparatus comprising the electrophotographic photoconductor as described above, a charge means that charges the electrophotographic photoconductor, an exposure means that exposes the charged electrophotographic photoconductor to light and a developing means that develops an electrostatic latent image formed by the exposure means.

According to the present invention, the amine compound represented by the formula (1) to be contained in the resin composition constituting the surface protective layer of the electrophotographic-photoconductor (hereinafter referred to simply as a photoconductor as the case may be) has a function as an initiator polymerizing an ingredient (for example, a monomer, oligomer or polymer) of the resin composition. Also, the amine compound which is not incorporated (not chemically bonded) into the polymer chain by polymerization does not deteriorate electric properties such as electrostatic property, sensitivity and response even if the resin composition constituting the surface protective layer is a single compound, but is superior in oxidizing gas resistance such as ozone resistance and nitrogen oxide resistance and has the function of improving the strength of the coating layer and also stabilizing the electric properties of the layer. In short, the electrophotographic photoconductor of the present invention attains an improvement in the strength of the coating layer and the stabilization of electric properties at the same time.

It is inferred that the reason why the superior oxidizing gas resistance is imparted to the photoconductor is that the amine compound represented by the formula (1) traps oxidizing gases such as ozone, nitrogen oxides, chlorine oxides and sulfur oxides intruded from the outside in the surface protective layer to thereby prevent these oxidizing gases from penetrating into the charge transport layer, thereby hindering these oxidizing gases from running a reaction producing ion pairs associated with electron transfer between these oxidizing gases and the charge transport material and from adhering to the charge generating material. It is therefore considered that in the photoconductor of the present invention, a fatigue deterioration is restricted, so that, for example, a reduction in surface potential, a rise in residual potential, a reduction in sensitivity and a reduction in resolution due to a reduction in surface resistance are not caused.

Also, according to the image forming apparatus of the present invention, the electrophotographic photoconductor is used which is superior in electric properties such as electrostatic property, sensitivity and response, oxidizing gas resistance and such electric durability that its good electric properties are not deteriorated even if it is used repeatedly, whereby a high quality image can be formed stably for a long period of time and a highly reliable image forming apparatus is therefore attained.

DESCRIPTION OF THE PREFERRED EMBODIMENT

Figure 1:
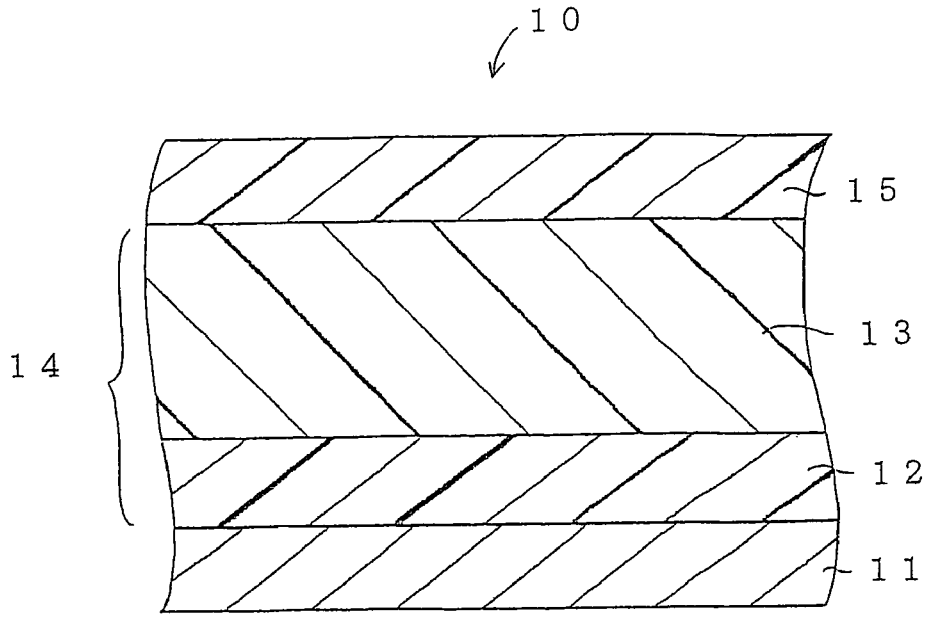
FIG. 1 is a partial sectional view simply showing the structure of an embodiment 1 of an electrophotographic photoconductor according to the present invention.

The electrophotographic photoconductor of the present invention comprising: an conductive support; a light-sensitive layer formed on the conductive support and containing a charge generating material and a charge transport material; and a surface protective layer formed on the light-sensitive layer and made of a resin composition, wherein the resin composition constituting the surface protective layer contains an amine compound represented by the following formula (1):

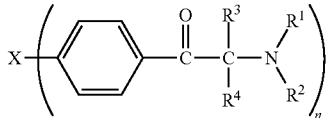

(1)

wherein R1 and R2 are, the same or different, each an alkyl group or an allyl group which may have a substituent or a heterocyclic residue to be formed through or not through a nitrogen atom or an oxygen atom together with the nitrogen atom to which R1 and R2 are bonded, R3 and R4 are, the same or different, each an alkyl group having a substituent and n denotes 1 or 2, provided that when n is 1, X is a hydrogen atom, a halogen atom, or an alkyl, hydroxyl or a mercapto group which may have a substituent, or a ring optionally containing an oxygen atom or a nitrogen atom between carbon atoms and when n is 2, X is an oxygen atom or a sulfur atom.

Here, the amine compound contained in the above resin composition constituting the surface protective layer means not an amine compound which is chemically bonded to a polymer chain but an amine compound present in the state of the structure represented by the above formula (1) between polymer chains.

The amine compound represented by the above formula (1) in the present invention will be explained in detail.

Examples of the alkyl group, which may have a substituent, represented by R1 or R2 in the above formula (1) include alkyl groups having 1 to 8 carbon atoms, for example, straight-chain alkyl groups such as methyl group, ethyl group, n-propyl group, n-butyl group and n-hexyl group and branched alkyl groups such as isopropyl group, t-butyl group and neopentyl group. Among these groups, lower alkyl groups having 1 to 4 carbon atoms are preferable and methyl group or ethyl group is more preferable.

Examples of the substituent of which the alkyl group represented by R1 or R2 may include an alkoxy group, phenyl group and a halogen atom such as fluorine atom, chlorine atom or bromine atom.

Examples of the alkoxyl group which may be possessed by the alkyl group represented by R1 or R2 are methoxy group, ethoxy group, propoxy group (including structural isomers), butoxy group (including structural isomers) and pentoxy group (including structural isomers). Among them, lower alkoxy groups having 1 to 4 carbon atoms are preferable and methoxy group or ethoxy group is more preferable.

The phenyl group which may be possessed by the alkyl group represented by R1 or R2 may have a substituent.

Examples of the substituent include lower alkyl groups such as methyl group, ethyl group and propyl group, lower alkoxy groups such as methoxy group, ethoxy group and propoxy group and a halogen atom such as fluorine atom, chlorine atom or bromine atom.

Examples of the heterocyclic residue to be formed through or not through a nitrogen atom or an oxygen atom together with the nitrogen atom to which R1 and R2 are bonded include a pyrrolidinyl group, piperidino group, morpholino group and piperazinyl group to be formed together with the nitrogen atom to which R1 and R2 are bonded wherein the nitrogen atom in the piperazinyl group may be substituted with a lower alkyl group having 1 to 4 carbon atoms. A carbon atom in the above pyrrolidinyl group, piperidino group, morpholino group and piperazinyl group to be formed together with the nitrogen atom to which R1 and R2 are bonded may be substituted with an alkyl group (preferably a lower alkyl group having 1 to 4 carbon atoms), alkoxy group (preferably a lower alkoxy group having 1 to 4 carbon atoms), or a halogen atom such as fluorine atom, chlorine atom or bromine atom.

Among these groups, a piperidino group, morpholino group and piperazinyl group to be formed together with the nitrogen atom to which R1 and R2 are bonded wherein the nitrogen atom in the piperazinyl group may be substituted with a lower alkyl group (preferably methyl group or ethyl group) are preferable.

In the formula (1), examples of the alkyl group represented by R3 or R4 which may have a substituent include alkyl groups having 1 to 8 carbon atoms, for example, straight-chain alkyl groups such as methyl group, ethyl group, n-propyl group, n-butyl group and n-hexyl group and branched alkyl groups such as isopropyl group, t-butyl group and neopentyl group. Among them, lower alkyl groups having 1 to 4 carbon atoms are preferable and methyl group or ethyl group is more preferable.

At this time, examples of the substituent of which the alkyl group represented by R3 or R4 may have include an alkoxy group, phenyl group, alkoxycarbonyl group and halogen atoms such as a fluorine atom, chlorine atom and bromine atom. Among them, a phenyl group and a lower alkoxy carbonyl group having 2 to 4 carbon atoms are preferable.

In the formula (1), examples of the halogen atom represented by X when n is 1 include fluorine atom, chlorine atom and bromine atom. Among them, fluorine atom and chlorine atom are preferable.

In the formula (1), examples of the alkyl group which is represented by X when n is 1 and may have a substituent include alkyl groups having 1 to 8 carbon atoms, for example, straight-chain alkyl groups such as methyl group, ethyl group, n-propyl group, n-butyl group and n-hexyl group and branched alkyl groups such as isopropyl group, t-butyl group and neopentyl group. Among them, lower alkyl groups having 1 to 4 carbon atoms are preferable and methyl group or ethyl group is more preferable.

Examples of the substituent which may be possessed by the alkyl group represented by X when n is 1 include lower alkoxy groups such as methoxy group, ethoxy group and propoxy group and a halogen atom such as fluorine atom, chlorine atom or bromine atom.

In the formula (1), examples of the substituent which may be possessed by the hydroxyl group represented by X when n is 1 include alkyl groups having 1 to 8 carbon atoms, for example, straight-chain alkyl groups such as methyl group, ethyl group, n-propyl group, n-butyl group and n-hexyl group and branched alkyl groups such as isopropyl group, t-butyl group and neopentyl group, and a phenyl group. Among these groups, lower alkyl groups having 1 to 4 carbon atoms and particularly, methyl group or ethyl group and phenyl group are preferable.

The phenyl group which may be possessed by the hydroxyl group represented by X when n is 1 may have a substituent. Examples of the substituent include lower alkyl groups having 1 to 4 carbon atoms such as methyl group, ethyl group and propyl group, lower alkoxy groups having 1 to 4 carbon atoms such as methoxy group, ethoxy group and propoxy group and a halogen atom such as fluorine atom, chlorine atom or bromine atom.

In the formula (1), examples of the substituent which may be possessed by the mercapto group represented by X when n is 1 include alkyl groups having 1 to 8 carbon atoms, for example, straight-chain alkyl groups such as methyl group, ethyl group, n-propyl group, n-butyl group and n-hexyl group and branched alkyl groups such as isopropyl group, t-butyl group and neopentyl group and a phenyl group. Among these groups, lower alkyl groups having 1 to 4 carbon atoms and particularly, a methyl group or ethyl group and phenyl group are preferable.

The phenyl group which may be possessed by the mercapto group represented by X when n is 1 may have a substituent. Examples of the substituent include lower alkyl groups having 1 to 4 carbon atoms such as methyl group, ethyl group and propyl group, lower alkoxy groups having 1 to 4 carbon atoms such as methoxy group, ethoxy group and propoxy group and a halogen atom such as fluorine atom, chlorine atom or bromine atom.

In the formula (1), examples of the ring which is represented by X when n is 1 and optionally contains an oxygen atom or a nitrogen atom between carbon atoms include a piperidino group, morpholino group or a piperazinyl group in which the alkyl group may be substituted with nitrogen atom. At this time, as the alkyl group with which the nitrogen atom of the piperazinyl group represented by X when n is 1 is substituted, lower alkyl groups having 1 to 4 carbon atoms such as methyl group, ethyl group and propyl group are preferable and methyl group or ethyl group is more preferable. The piperidino group, morpholino group or piperazinyl group represented by X when n is 1 may contain a carbon atom substituted with an alkoxy group (preferably, lower alkoxy groups having 1 to 4 carbon atoms) or a halogen atom such as fluorine atom, chlorine atom or bromine atom.

Among these groups, a morpholino group is preferable as the ring which is represented by X when n is 1 and optionally contains an oxygen atom and a nitrogen atom between carbon atoms.

In the formula (1), R1 and R2 when n is 2 may be represented by the same substituent (including an atom) when n is 1. Among them, lower alkyl groups having 1 to 4 carbon atoms are preferable and methyl group or ethyl group is more preferable.

In the formula (1), R3 and R4 when n is 2 may be represented by the same substituent (including an atom) when n is 1. Among them, lower alkyl groups which have 1 to 4 carbon atoms and may be substituted with a phenyl group are preferable and methyl group or ethyl group is more preferable.

In the present invention, preferable and specific examples of the amine compound represented by the formula (1) may include the exemplified compounds No. 1 to No. 29 shown in the following Tables 1 to 5. However, the amine compounds represented by the formula (1) in the present invention are not limited to these examples.

TABLE 1
| Exemplified compound No | Structure formula |
|---|---|
| 1 | 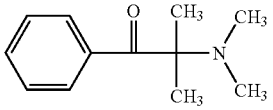 |
| 2 | 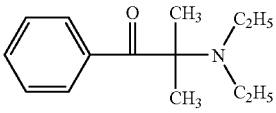 |
| 3 | 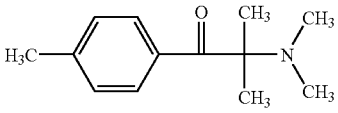 |
| 4 | 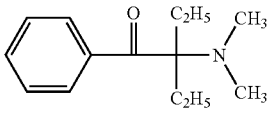 |
| 5 | 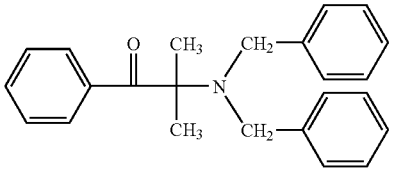 |
| 6 | 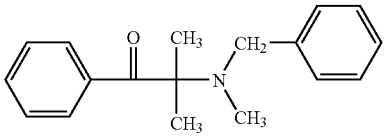 |
| 7 | 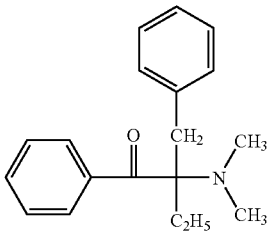 |
TABLE 2
| Exemplified compound No | Structure formula |
|---|---|
| 8 | 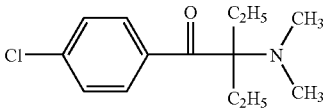 |
| 9 | 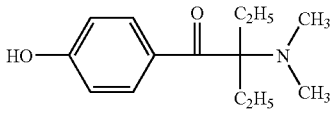 |
| 10 | 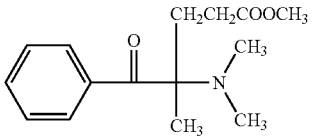 |
| 11 | 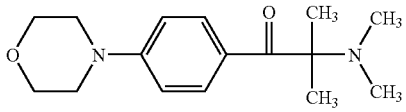 |
| 12 | 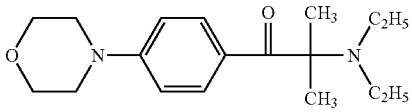 |
| 13 | 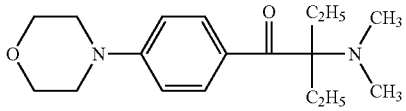 |
| 14 | 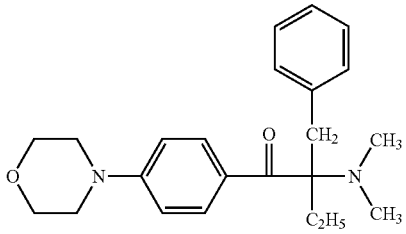 |
TABLE 3
| Exemplified compound No | Structure formula |
|---|---|
| 15 | 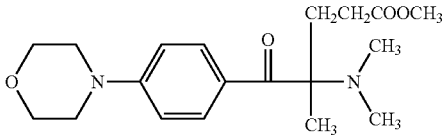 |
| 16 | 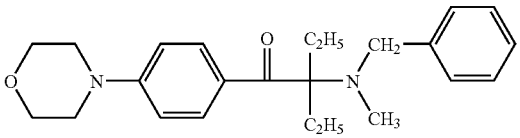 |

TABLE 3-continued
| Exemplified compound No | Structure formula |
|---|---|
| 17 | 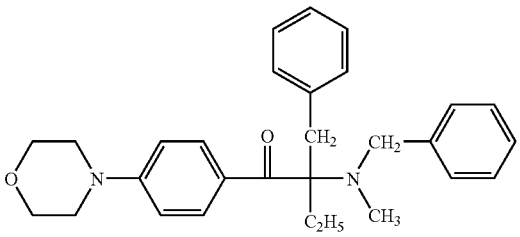 |
| 18 | 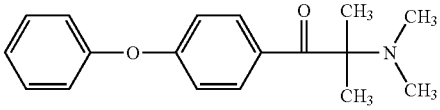 |
| 19 | 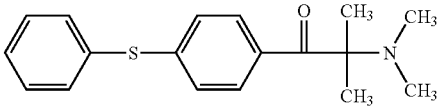 |
| 20 | 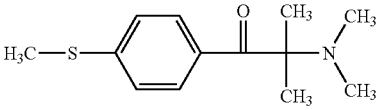 |
TABLE 4
| Exemplified compound No | Structure formula |
|---|---|
| 21 | 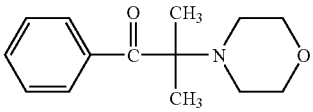 |
| 22 | 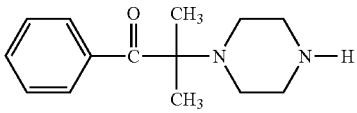 |
| 23 | 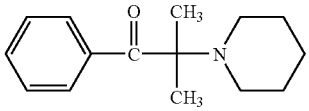 |
| 24 | 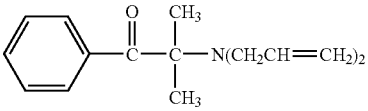 |
TABLE 4-continued
| Exemplified compound No | Structure formula |
|---|---|
| 25 | 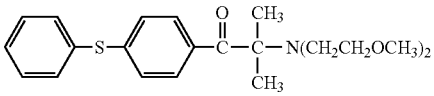 |
| 26 | 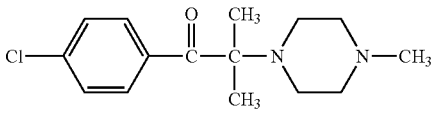 |
| 27 | 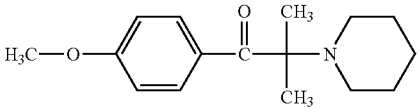 |
TABLE 5
| Exemplified compound No | Structure formula |
|---|---|
| 28 | 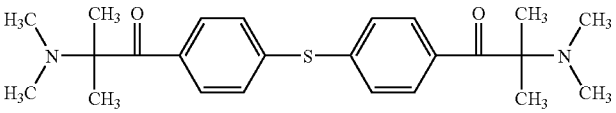 |

TABLE 5-continued

| Exemplified compound No | Structure formula |
|---|---|
| 29 | 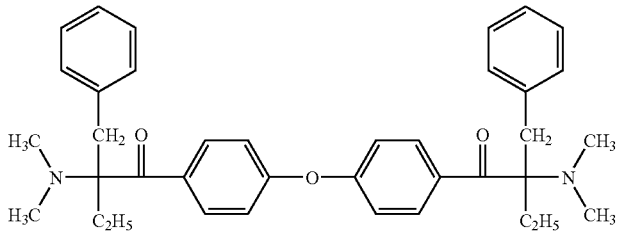 |

The above amine compounds according to the present invention are preferably those represented by the above formula (1) in which, when n is 1, R3 and R4 are, the same or different, each an alkyl group which has 1 to 8 carbon atoms and optionally contains, as a substituent, a phenyl group or an alkoxycarbonyl group having 2 to 5 carbon atoms, X is a hydrogen atom, a halogen atom, a hydroxyl group, an alkyl group having 1 to 4 carbon atoms, an alkoxy group having 1 to 4 carbon atoms, an alkylthio group having 1 to 4 carbon atoms, a phenylthio group, a phenoxy group or a morpholino group, from the viewpoint of more improving the ability of suppressing the fatigue deterioration of the photoconductor. Given as specific examples are the above exemplified compounds No. 1 to No. 27.

Moreover, the amine compounds are preferably those represented by the above formula (1) in which, when n is 1, R1 and R2 are each an alkyl group having 1 to 4 carbon atoms, R3 and R4 are, the same or different, each an alkyl group which has 1 to 8 carbon atoms and optionally contains, as a substituent, a phenyl group or an alkoxycarbonyl group having 2 to 5 carbon atoms, X is a hydrogen atom or a morpholino group. Given as specific examples are the above exemplified compounds No. 11 to No. 15. Such an amine compound has high reactivity as an initiator and it is therefore possible to form a firm coating film as the surface protective layer.

According to the present invention, oxidizing gas resistance such as ozone resistance and nitrogen oxide resistance can be imparted to the photoconductor by compounding the amine compounds represented by the formula (1) in the surface protective layer. This is inferred to be because the amine compound represented by the formula (1) can trap oxidizing gases such as ozone, nitrogen oxides, chlorine oxides and sulfur oxides intruded from the outside to thereby hinder these oxidizing gases from adhering and these oxidizing gases from running a reaction producing ion pairs associated with electron transfer between these oxidizing gases and the charge transport material and/or from adhering to the charge generating material. It is therefore considered that in the photoconductor, a fatigue deterioration is restricted, so that, for example, a reduction in surface potential, a rise in residual-potential, a reduction in sensitivity and a reduction in resolution due to a reduction in surface resistance are scarcely caused resultantly.

Also, the amine compound represented by the formula (1) does not deteriorate the electric properties such as electrostatic property, sensitivity and response of the photoconductor even if it is added to the surface protective layer. In other words, the amine compound does not deteriorate the electric properties such as electrostatic property, sensitivity and response of the photoconductor but can impart oxidizing gas resistance such as ozone resistance and nitrogen oxide resistance to the photoconductor. Therefore, if the surface protective layer is made to contain the amine compound represented by the formula (1), a photoconductor is attained which is superior in electric properties such as electrostatic property, sensitivity and response, also superior in oxidizing gas resistance such as ozone resistance and nitrogen oxide resistance and has excellent electric durability that is a resistance to a deterioration in good electric characteristics even if the photoconductor is used repeatedly.

In the present invention, the amine compounds represented by the formula (1) may be used either singly or in combinations of two or more.

When the surface protective layer is formed, the amount of the amine compound of the formula (1), is an initiator and also a electric property-stabilizing agent and is added to a coating solution which is a raw material of the surface protective layer is preferably 10 to 20 parts by weight and more preferably 12 to 18 parts by weight based on 100 parts by weight of the total solid of the uncured surface protective layer coating film. The amine compound is allowed to remain in a necessary amount of 2 to 5% by weight based on the total weight of the surface protective layer in the cured surface protective layer without fail. This attains an improvement in the stabilization of the electric properties of the photoconductor and an improvement in the strength of the surface protective layer at the same time more exactly. When the amount of the amine compound represented by the formula (1) is less than 10 parts by weight based on 100 parts by weight of the total solid weight of the uncured surface protective layer coating film, the content of the amine compound in the surface protective layer obtained after the polymerization is completed is 2% or less, which makes difficult to obtain the resistance to oxidizing gases such as ozone and nitrogen oxide, so that there is the case where, for instance, a reduction in surface potential and a reduction in sensitivity are caused when the photoconductor is used repeatedly. When the amount of the amine compound to be used exceeds 20 parts by weight based on 100 parts by weight of the above total solid, on the other hand, the molecular weight of the resin constituting the surface protective layer is decreased and the film strength tends to be dropped.

In the present invention, the amine compound represented by the formula (1) may be produced based on the methods described in, for example, the publication of Japanese Patent Publication (JP-B) No. 62-9124 and the publication of JP-B No. 1-34242.

The amine compound represented by the formula (1) may be produced as follows. Specifically, a ketone compound represented by the following formula (1a) is halogenated (1a)

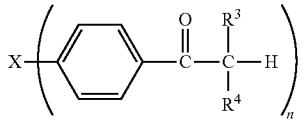

wherein $R^3$, $R^4$, X and n have the same meanings as those defined in the formula (1), to obtain a ketone halide compound represented by the following formula (1b)

(1b)

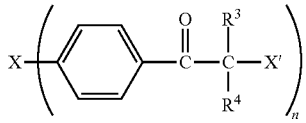

wherein X' represents a halogen atom and $R^3$, $R^4$, X and n have the same meanings as those defined in the formula (1). Then, the ketone halide compound is epoxidized to obtain an epoxide intermediate represented by the following formula (1c)

(1c)

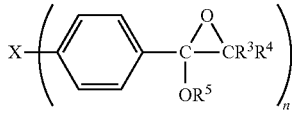

wherein $R^5$ represents an alkyl group and $R^3$, $R^4$, X and n have the same meanings as those defined in the formula (1). Thereafter, the epoxide intermediate is reacted with an amine compound represented by the following formula (1d)

$$HNR^1R^2 \quad (1d)$$

wherein $R^1$ and $R^2$ have the same meanings as those defined in the formula (1).

The halogenating reaction of the ketone compound of the above formula (1a) may be run as follows. The ketone compound of the formula (1a) is dissolved in an inert solvent such as tetrachloromethane. A halogenating agent such as chlorine ($Cl_2$) or bromine ($Br_2$) is added in a stoichiometric amount to the solution to react while the solution is kept at 40 to 80° C. Nitrogen is introduced into the resulting reaction mixture to remove byproducts including hydrogen halides such as hydrogen chloride (HCl) and hydrogen bromide (HBr) and then the solvent is removed. The ketone halide compound of the above formula (1b) is thus obtained.

The epoxidation of the ketone halide compound of the formula (1b) may be run in the following manner. The ketone halide compound of the formula (1b) is dissolved in a solvent such as methanol and this solution is added dropwise to a solution prepared by dissolving a metal alkoxide in a stoichiometric amount in a solvent such as methanol at a reflux temperature to react. As the metal alkoxide, a salt such as an alkali metal, for example, sodium methoxide, of an alcohol having 1 to 4 carbon atoms and sodium or potassium is preferably used. After the reaction is finished, the solvent is distilled and the reaction solution is purified according to the need to obtain the epoxide intermediate of the formula (1c). In the formula (1c), the alkyl group of the $R^5$ corresponds to the alkyl group of the metal alkoxide.

The reaction between the epoxide intermediate of the formula (1c) and the amine compound of the formula (1d) is run in the following manner. The epoxide intermediate of the formula (1c) is crosslinked using the amine compound of the formula (1d) in a stoichiometric amount in the absence or presence of a solvent such as toluene or xylene, wherein the reaction is run at 100 to 200° C. for about 10 to 20 hours. Here, this reaction is run under pressure, for example, in an autoclave in the case where the amine compound of the formula (1d) is a low-boiling point amine compound such as dimethylamine or diethylamine obtained when $R^1$ and $R^2$ respectively have 1 to 4 carbon atoms. The reaction mixture is diluted with benzene or the like and extracted with a dilute acid such as dilute hydrochloric acid. The obtained aqueous acid solution is alkalinized by adding a base such as sodium hydroxide and extracted with an ether or the like. Then, the extract is washed with water and then the solvent is distilled and the extract is then purified according to the need. The amine compound of the formula (1) is thus obtained.

Also, the amine compound of the formula (1) may also be produced by reacting the ketone halide compound of the formula (1b) with the amine compound of the above formula (1d). In this case, the ketone halide compound of the formula (1b) is diluted with a solvent such as toluene according to the need and mixed with 2 mol equivalent of the amine compound of the formula (1d) to react at 100 to 200° C. for 10 to 20 hours. Here, this reaction is also run under pressure, for example, in an autoclave in the case where the amine compound of the formula (1d) is a low-boiling point amine compound such as dimethylamine or diethylamine obtained when $R^1$ and $R^2$ respectively have 1 to 4 carbon atoms. The reaction mixture is then subjected to aftertreatment carried out in the same manner as in the case of the reaction mixture obtained by the reaction of the aforementioned epoxide intermediate and the compound of the formula (1d) and then purified according to the need to obtain the amine of the formula (1).

In the present invention, the surface protective layer may further contain a charge transport material. This improves the movement of charges in the layer and it is therefore possible to prevent a rise in residual potential in repeat use.

The content of the charge transport material in the surface protective layer is preferably 1 to 20% by weight and more preferably 3 to 10% by weight based on the total solid constituting the surface protective layer. When the content of the charge transport material in the surface protective layer exceeds 20% by weight, the strength of the film is low and a desired effect of improving wear resistance is not obtained. When the content of the charge transport material in the surface protective layer is less than 1% by weight, charge transfer ability in the layer is deteriorated, giving a rise in residual potential in repeat use.

Also, in the present invention, the surface protective layer may, further contain a filler. This enables an improvement in the wear resistance of the surface protective layer.

The content of the filler in the surface protective layer is preferably 1 to 50% by weight and more preferably 5 to 30% by weight based on the total solid constituting the surface protective layer. When the content of the filler in the surface protective layer exceeds 50% by weight, there is a fear as to a rise in residual potential though wear resistance is improved. Also, the light transmittance of the surface protective layer is decreased so that the light applied when the exposure operation is carried out insufficiently reaches the charge generation material and there is therefore a fear as to a reduction in sensitivity. When the content of the filler in the surface protective layer is less than 1% by weight, the desired effect of improving the wear resistance of the surface protective layer is not obtained.

There is no particular limitation to the light-sensitive layer of the electrophotographic photoconductor which is the subject of the present invention. Examples of the light-sensitive layer include light-sensitive layers that are usually used in the field concerned, for example, a light-sensitive layer having a two-layer structure consisting of a charge generation layer and a charge transport layer, a light-sensitive layer having a one-layer structure having a charge generation function and a charge transfer function and a light-sensitive layer prepared by laminating these one-layer or two-layer structure on an intermediate layer as an undercoat layer.

Embodiments of the electrophotographic photoconductor of the present invention will be explained with reference to the drawings.

Embodiment 1

Figure 4:
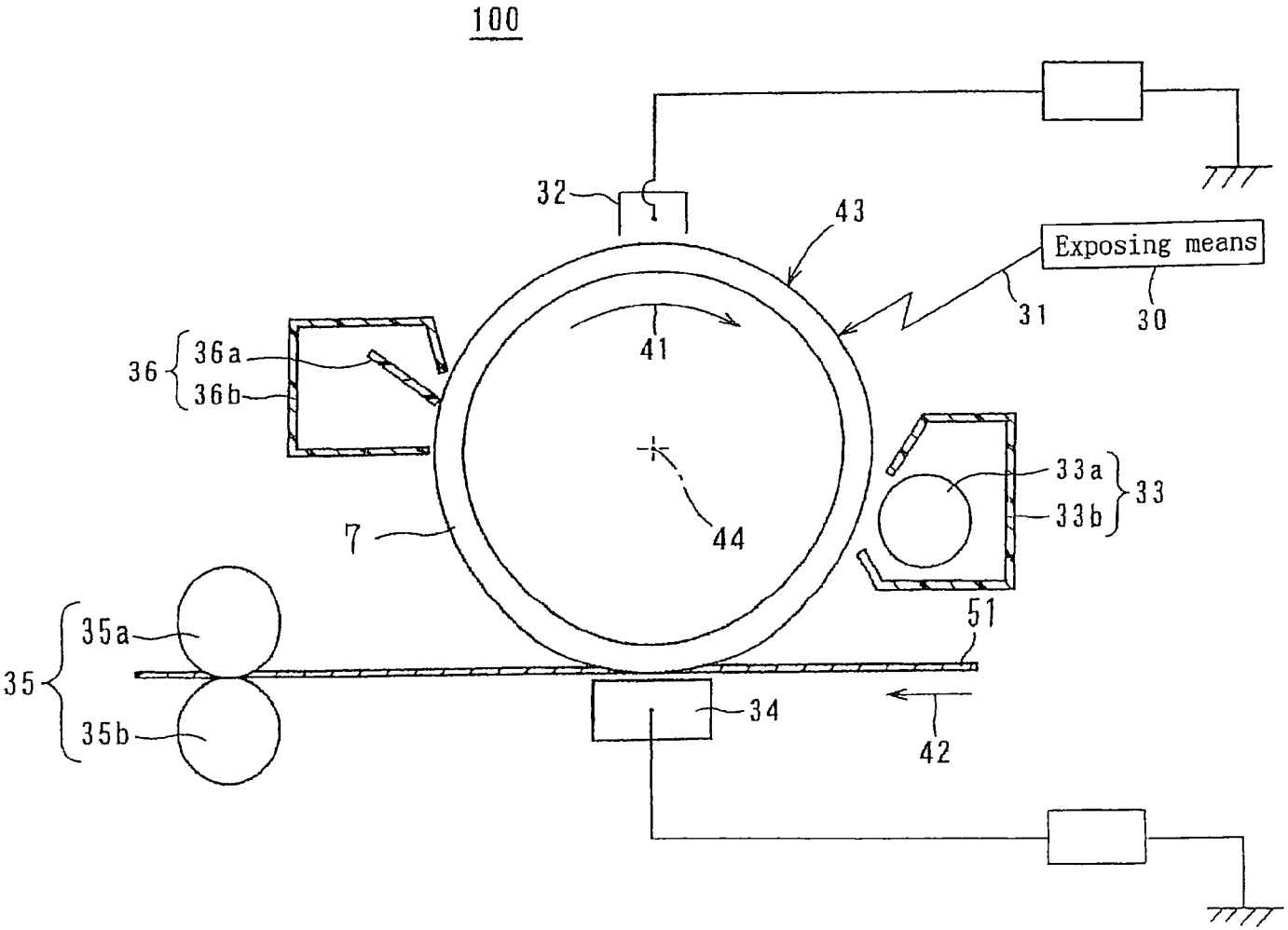
FIG. 4 is an arrangement side view simply showing the structure of an embodiment of an image forming apparatus according to the present invention.

FIG. 1 is a partially sectional view showing the simplified structure of an embodiment 1 of the electrophotographic photoconductor of the present invention. This electrophotographic photoconductor 10 has a cylindrical form and is used in an image forming apparatus 100 as shown in FIG. 4. The image forming apparatus provided with the photoconductor 10 of the present invention will be explained in detail wherein the symbol 7 represents the photoconductor in FIG. 4.

As shown in FIG. 1, this photoconductor 10 has a cylindrical conductive support 11 made of an conductive material, a charge generation layer 12 which is a layer laminated on the conductive support 11 and contains a charge generation material, a charge transport layer 13 which is a layer laminated on the charge generation layer 12 and contains a charge transport material and a surface protective layer 15 which is a layer laminated on the charge transport layer 13 and contains the amine compound of the formula (1). The charge generation layer 12 and the charge transport layer 13 constitutes a light-sensitive layer 14 which is a laminate type photoconductive layer.

Because it is possible to select materials constituting each layer independently by making separate layers serve to perform the charge generation function and the charge transfer function respectively in this manner, it is possible to select a material most suitable to each of the charge generation function and charge transfer function. It is therefore possible to improve the electric properties of the photoconductor such as electrostatic property, sensitivity and response. Therefore, the electrophotographic photoconductor 10 is attained which is superior in electric properties and improved in the stability of the electric properties when it is used repeatedly can be obtained.

Each layer constituting the photoconductor 10 will be explained.

(Conductive Support)

The conductive support 11 serves as an electrode of the photoconductor 1 and also functions as a support member of each of other layers. The shape of the conductive support 11 has a cylindrical form in this embodiment. However, the shape of the conductive support 11 is not limited to this and may be a columnar form or an endless belt or sheet form.

As the conductive material constituting the conductive support 11, for example, a single metal such as aluminum, copper, zinc or titanium or an alloy such as an aluminum alloy or stainless steel may be used. The conductive material is not limited to these metal materials and a material obtained by laminating a metal foil, by depositing a metal material or by depositing or applying an conductive polymer, tin oxide or indium oxide on the surface of a high-molecular material such as polyethylene terephthalate, nylon or polystyrene, hard paper or glass may be used. These conductive materials are used after processed into a specific shape.

The surface of the conductive support 11 may be subjected to anodic oxidation coating treatment, surface treatment using a chemical or hot water, coloring treatment or irregular reflection treatment such as surface roughening treatment according to the need to the extent that the image quality is not adversely affected. Because laser light is regular in wavelengths in an electrophotographic process using a laser as the exposure light source, there is the case where the laser light reflected on the surface of the photoconductor interferes with the laser light reflected on the inside of the photoconductor and interference stripes caused by the interference appear on an image, bringing about image defects. The aforementioned surface treatment of the conductive support 11 can prevent the image defects caused by the interference of laser light regular in wavelengths.

(Light-Sensitive Layer)

The light-sensitive layer 14 is constituted of a laminate type photoconductive layer 14 produced by laminating the charge generation layer 12 containing a charge generating material and the charge transport layer 13 containing a charge transport material as mentioned above. Because it is possible to select materials constituting each layer independently by making separate layers serve to perform the charge generation function and the charge transfer function respectively in this manner, it is possible to select a material most suitable to each of the charge generation function and charge transfer function. Therefore, the photoconductor 1 in this embodiment is particularly superior in the electric properties such as electrostatic property, sensitivity and response and also in the stability, namely electric durability, of the electric properties when it is used repeatedly.

(Charge Generation Layer)

The charge generation layer 12 contains a charge generating material that generates charges when it absorbs light and may further contain at least one of the amine compounds of the above formula (1) according to the need.

Examples of a material effective as the charge generating material may include organic photoconductive materials, for example, azo type pigments such as monoazo type pigments, bisazo type pigments and trisazo type pigments, indigo type pigments such as indigo and thioindigo, perylene type pigments such as perylene imide and perylenic acid anhydride, polycyclic quinone type pigments such as anthraquinone and pyrenequinone, phthalocyanine type pigments such as metal phthalocyanines, for example, oxotitanium phthalocyanine and nonmetal phthalocyanine, squalillium dyes, pyrylium salts, thiopyrylium salts and triphenylmethane type dyes and inorganic photoconductive materials, for example, selenium and amorphous silicon.

Among these charge generating materials, oxotitanium phthalocyanine is preferably used. The above oxotitanium phthalocyanine may be those substituted with substituents such as a halogen atom such as a chlorine atom or fluorine atom, nitro group, cyano group or sulfonic acid group for a hydrogen atom of a benzene ring contained a phthalocyanine group or those in which a ligand is coordinated with the center metal. The above oxotitanium phthalocyanine is superior in charge generation function and charge injecting function. Therefore, it can absorb light to generate a large number of charges and also does not accumulate the generated charges in itself but injects the generated charges efficiently into the charge transport material contained in the charge transport layer 13. Therefore, the photoconductor 10 which has particularly high sensitivity and excellent resolution is attained by using oxotitanium phthalocyanine as the charge generating material.

The charge generating materials may be used either singly or in combinations of two or more.

The charge generating material may be used in combination with sensitizing dyes such as triphenylmethane type dyes typified by Methyl Violet, Crystal Violet, Night blue and Victoria Blue, acridine dyes typified by Erythrocin, Rhodamine B, Rhodamine 3R, Acridine Orange and Furapeocine, thiazine dyes typified by Methylene Blue and Methylene Green, oxazine dyes such as Capri Blue and Meldra Blue, cyanine dyes, styryl dyes, pyrylium salt dyes and thiopyrylium salt dyes.

The charge generation layer 12 may contain a binder resin for the purpose of improving binding characteristics. Examples of the binder resin may include a polyester resin, polystyrene resin, polyurethane resin, phenol resin, alkyd resin, melamine resin, epoxy resin, silicone resin, acryl resin, methacryl resin, polycarbonate resin, polyarylate resin, phenoxy resin, polyvinylbutyral resin and polyvinylformal resin, and copolymer resins containing two or more repeat units constituting these resins. Specific examples of the copolymer resin include insulating resins such as vinyl chloride/vinyl acetate copolymer resins, vinyl chloride/vinyl acetate/maleic anhydride copolymer resins and acrylonitrile/styrene copolymer resins. The binder resin is not limited to these examples and resins generally used in this field may be used as the binder resin to be used in the charge generation layer 12. These binder resins may be used either singly or in combinations of two or more.

In the charge generation layer 12 constituted by compounding the charge generating material and the binder resin, the ratio W1/W2 of the weight W1 of the charge generating material to the weight W2 of the binder resin is preferably 10/100 to 99/100 (0.1 to 0.99). When the above ratio is less than 10/100, there is the possibility of a reduction in the sensitivity of the photoconductor 10. When the ratio exceeds 99/100, there is the possibility of a reduction in the film strength of the charge generation layer 12. Also, there is a fear that the dispersibility of the charge generating material is reduced, leading to an increase in coarse particles and the surface charge of a part other than the part to be erased is reduced by exposure to light, resulting in an increase in image defects, particularly image fogging called "black dot" which is a phenomenon that a toner adheres to a white background to form small black points.

As a method of forming the charge generation layer 12, a method in which the aforementioned charge generating material is deposited under vacuum on the surface of the conductive support 11 or a method in which the aforementioned charge generating material and, according to the need, the aforementioned binder resin are added in a proper solvent and dispersed and/or dissolved by the conventionally known method to prepare a charge generation layer coating solution and the resulting coating solution is applied to the surface of the conductive support 11.

Examples of the solvent to be used in the charge generation layer coating solution include hydrocarbon halides such as dichloromethane and dichloroethane, ketones such as acetone, methyl ethyl ketone and cyclohexanone, esters such as ethyl acetate and butyl acetate, ethers such as tetrahydrofuran and dioxane, alkyl ethers of ethylene glycol such as 1,2-dimethoxyethane, aromatic hydrocarbons such as benzene, toluene and xylene and aprotic polar solvents such as N,N-dimethylformamide and N,N-dimethylacetamide. Among these solvents, non-halogen type organic solvents are preferably used taking global atmosphere into account. These solvents may be used either singly or as mixture solvents obtained by combining two or more.

The charge generating material may be pulverized by a pulverizer in advance before it is dispersed in a solvent. Examples of the pulverizer used in pulverizing treatment may include a ball mill, sand mill, attritor, oscillating mill and ultrasonic dispersing machine.

Examples of the dispersing machine to be used when dispersing the charge generating material in a solvent may include a paint shaker, ball mill and sand mill. As the dispersing condition, a proper condition is selected so as to prevent the contamination of impurities generated by the abrasion of the members constituting the container and dispersing machine to be used.

Examples of the method of applying the charge generation layer coating solution may include a spraying method, bar coating method, roll coating method, blading method, ring method and dip coating method. Among these methods, particularly the dip coating method is a method in which a base member is dipped in a coating vessel filled with a coating solution and then pulled up at a constant speed or sequentially varying speed to form a layer on the surface of the base member. This method is simple and superior in productivity and cost and is therefore preferably used. The device used in the dip coating method may be provided with a coating solution dispersing machine typified by a ultrasonic generator to stabilize the dispersibility of the coating solution. It is to be noted that the coating method is not limited to these methods and the most suitable method may be properly selected in consideration of the properties of the coating solution and productivity.

The layer thickness of the charge generation layer 12 is preferably 0.05 to 5 μm and more preferably 0.1 to 1 μm. If the layer thickness of the charge generation layer 12 is less than 0.05 μm, the effect of absorbing light is deteriorated and there is therefore a fear that the sensitivity of the photoconductor 10 is reduced. If the layer thickness of the charge generation layer 12 exceeds 5 μm, the charge transfer inside of the charge generation layer 12 is the rate-determining step in the process for erasing the charge on the surface of the light-sensitive layer 14 and there is therefore a fear that the sensitivity of the photoconductor 10 is reduced.

(Charge Transport Layer)

The charge transport layer 13 to be formed on the charge generation layer 12 may be constituted of a charge transport material having the ability to receive the charges generated in the charge generating material which is included in the charge generation layer 12 and to carry these charges and a binder resin that binds the charge transport material. The charge transport layer 13 contains the amine compound of the formula (1) according to the need.

As the charge transport material, any material may be used without any particular limitation insofar as it can transfer the charges generated in the charge generating material and various compounds may be used. Examples of the charge transport material may include carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives and benzidine derivatives. Also, polymers having a group produced from these compounds on a principal chain or side chain, for example, poly(N-vinylcarbazole), poly(1-vinylpyrene) and poly(9-vinylanthracene) are given as examples. These charge transport materials may be used either singly or in combinations of two or more.

As the binder resin constituting the charge transport layer 13, one which is highly compatible with the charge transport material is selected and used. Examples of the binder resin to be used in the charge transport layer 13 include polymethylmethacrylate resins, polystyrene resins and vinyl polymer resins such as polyvinyl chloride resins and vinyl copolymer resins containing two or more repeat units constituting these resins, polycarbonate resins, polyester resins, polyester carbonate resins, polysulfone resins, phenoxy resins, epoxy resins, silicone resins, polyarylate resins, polyamide resins, polyether resins, polyurethane resins, polyacrylamide resins and phenol resins. Thermosetting resins obtained by crosslinking these resins partially are also given as examples. Among these resins, polystyrene resins, polycarbonate resins, polyarylate resins or phenylene oxide have a volume resistance of 1013 Ω·cm or more, have a high electrical insulation and are also superior in coatability and potential characteristics and are therefore preferably used. These binder resins may be used either singly or in combinations of two or more.

In the charge transport layer 13, the ratio A/B of the weight A of the charge transport material to the weight B of the binder resin is preferably 10/30 to 10/12 (about 0.33 to about 0.83). If the ratio is far less than 10/30 and therefore the ratio of the binder resin is too high, there is a fear that the sensitivity of the photoconductor 10 is dropped. Also, if the ratio is less than 10/30 when the charge transport layer 13 is formed by a dip coating method, there is a fear that the viscosity of the coating solution is so increased that coating speed is reduced, bringing about significantly low productivity. Also, if the amount of the solvent is increased to suppress an increase in the viscosity of the coating solution, a brushing phenomenon occurs and there is therefore the possibility that the formed charge transport layer 13 is cloudy. Also, if the ratio far exceeds 10/12 and therefore the ratio of the binder resin is too low, there is a fear that the wear resistance of the light-sensitive layer 14 is reduced so that the amount of the abrasion of the layer when the light-sensitive layer is used repeatedly is increased, leading to deteriorated electrostatic property of the photoconductor 10.

A plasticizer and a leveling agent may be added in the charge transport layer 13 to the extent that the desired characteristics of the present invention are not impaired. The addition of the plasticizer or leveling agent can improve the film-forming characteristics, flexibility and/or surface smoothness of the charge transport layer 13. Examples of the plasticizer may include a dibasic acid ester such as a phthalate ester, fatty acid ester, phosphate ester, paraffin chloride and epoxy type plasticizers. Examples of the leveling agent may include a silicone type leveling agent.

The charge transport layer 13 may be formed in the same manner as in the formation of the above charge generation layer 12 by using a coating method. Specifically, the aforementioned charge transport material, binder resin and, according to the need, the above additives are dissolved and/or dispersed in a proper solvent to prepare a charge transport layer coating solution and the obtained coating solution is applied to the surface of the charge generation layer 12.

Examples of the solvent used in the charge transport layer coating solution may include aromatic hydrocarbons such as benzene, toluene, xylene and monochlorobenzene, hydrocarbon halides such as dichloromethane and dichloroethane, ethers such as tetrahydrofuran, dioxane and dimethoxymethyl ether and aprotic polar solvents such as N,N-dimethylformamide. Among these solvents, non-halogen type organic solvents are preferably used taking global atmosphere into account. These solvents may be used either singly or in combinations of two or more. Also, solvents such as alcohols, acetonitrile or methyl ethyl ketone may be added to the above solvents according to the need when these solvents are used.

Examples of a method of applying the charge transport-layer coating solution may include a spraying method, bar coating method, roll coating method, blade method, ring method and dip coating method. Among these coating methods, particularly the dip coating method is superior in various points as mentioned above and is therefore preferably used in the case of forming the charge transport layer 13.

The layer thickness of the charge transport layer 13 is preferably 5 to 50 μm and more preferably 10 to 40 μm. When the layer thickness of the charge transport layer 13 is less than 5 μm, there is a fear that the charge retentive ability of the surface of the photoconductor is reduced. When the layer thickness of the charge transport layer 13 exceeds 50 μm, there is the possibility that the resolution of the photoconductor 10 is reduced.

One or two or more sensitizers such as an electron receiving material and dyes may be added to the light-sensitive layer (laminate type photoconductive layer) 14 to the extent that the desired characteristics of the present invention is not impaired. By the addition of the sensitizer, the sensitivity of the photoconductor 10 is improved, therefore, a rise in residual potential and fatigue caused by repeat use are more suppressed and electric durability is improved. These sensitizers may be contained in any of the charge generation layer 12 and charge transport layer 13 constituting the light-sensitive layer or in both the charge generation layer 12 and the charge transport layer 13.

As the electron receiving material, electron attractive materials including acid anhydrides such as succinic acid anhydride, maleic acid anhydride, phthalic acid anhydride and 4-chloronaphthalic acid anhydride, cyano compounds such as tetracyanoethylene and terephthalmalondinitrile, aldehydes such as 4-nitrobenzaldehyde, anthraquinones such as anthraquinone and 1-nitroanthraquinone, polycyclic or heterocyclic nitro compounds such as 2,4,7-trinitrofluorenone and 2,4,5,7-tetranitrofluorenone or diphenoquinone compound may be used. Also, high-molecular materials of these electron attractive materials may be used.

As the dye, organic photoconductive compounds such as xanthene type dyes, thiazine dyes, triphenylmethane dyes, quinoline type pigments or copper phthalocyanine may be used. These organic photoconductive compounds function as an optical sensitizer.

The light-sensitive layer 14 is a laminate type photoconductive layer produced by laminating the charge generation layer 12 and the charge transport layer 13 in this order on the conductive support 11 in this embodiment 1. However, the light-sensitive layer is not limited to this structure and may be a laminate type photoconductive layer produced by laminating a charge transport layer and a charge generation layer in this order on the conductive support 11.

(Surface Protective Layer)

The surface protective layer 15 to be formed on the light-sensitive layer 14 may be formed by applying a coating solution primarily containing an acryl type resin composition and containing at least one of a di- or more functional monomer, oligomer and single polymer or mixtures of polymers to the outside peripheral surface of the light-sensitive layer 14, followed by polymerizing.

Examples of the difunctional monomer, oligomer and polymer include diethylene glycol di(meth)acrylate, polyethylene glycol di(meth)acrylate, polypropylene glycol di(meth) acrylate, neopentyl glycol di(meth)acrylate and 1,6-hexanediol di(meth)acrylate. Examples of trifunctional monomer, oligomer and polymer include trimethylolpropane tri(meth)acrylate, pentaerythritol tri(meth)acrylate and aliphatic tri(meth)acrylate. Examples of tetrafunctional monomer, oligomer and polymer include pentaerythritol tetra (meth)acrylate and ditrimethylolpropanete tra(meth)acrylate and aliphatic tetra(meth)acrylate. Also, as the penta- or more functional monomer, oligomer and polymer, for example, dipentaerythritol penta(meth)acrylate, dipentaerythritol hexa (meth)acrylate and also (meth)acrylates having a polyester skeleton, urethane skeleton or phosphazene skeleton may be used.

The aforementioned amino compound contained in the surface protective layer 15 is used as an initiator when polymerizing at least one of the above di- or more functional monomer, oligomer and polymer and is, as mentioned above, an amine compound which is not bound as a part of the polymer chain but is left unchanged in its structure of the above formula (1) in the surface protective layer 15 in the polymerization. The amine compound left in the surface protective layer 15 is contained in an amount of 2 to 5% by weight based on the total weight of the surface protective layer 15 as mentioned above.

A filler may be added in the aforementioned content (1 to 50% by weight) in the surface protective layer 15 for the purpose of improving wear resistance. As the filler, any one of an organic filler and inorganic filler or the both may be used. Examples of the organic filler include fluororesin powders such as polytetrafluoroethylene, silicone resin powders and amorphous carbon powders. Examples of the inorganic filler include inorganic materials, for example, metal powders such as powders of copper, tin, aluminum and indium, metal oxides such as silicon dioxide (silica), aluminum oxide (alumina), tin oxide, zinc oxide, titanium oxide, indium oxide, antimony oxide, bismuth oxide, tin oxide doped with antimony and indium oxide doped with tin, alkali metal salts of titanic acid such as potassium titanate. Among these materials, inorganic fillers are preferably used in view of wear resistance. Because inorganic fillers have suitable hardness, particularly excellent wear resistance is obtained when these inorganic fillers are used. Among these inorganic fillers, metal oxides are preferable and silicon oxide, aluminum oxide and titanium oxide are particularly preferable.

The filler to be added to the surface protective layer 15 may be surface-treated using an inorganic material and/or organic material with the intention of improving dispersibility and reforming surface characteristics. Examples of the filler surface-treated (water repellent treatment) with an organic material include those treated with a silane coupling agent, those treated with a fluorosilane coupling agent and those treated with higher fatty acid. Examples of the filler surface-treated with an inorganic material include those surface-treated with alumina, zirconia, tin oxide or silica.

The average primary particle diameter of the filler is preferably 0.01 to 0.5 μm from the viewpoint of the light transmittance and wear resistance of the surface protective layer 15. When the average primary particle diameter of the filler is less than 0.01 μm, the wear resistance of the surface protective layer 15 is only insufficiently obtained and there is therefore a fear that the life of the photoconductor 10 is shortened. When the average primary particle diameter of the filler exceeds 0.5 μm, the light applied during exposure is easily scattered on the surface protective layer 15 and there is the possibility of deteriorated resolution.

The surface protective layer 15 may contain a charge transport material in the aforementioned content for the purpose of aiding charges to move in the layer. As the charge transport material, the same charge transport materials that are used in the foregoing charge transport layer may be used.

The layer thickness of the surface protective layer 15 is preferably 0.1 to 10 μm and more preferably 1 to 5 μm. When the layer thickness of the surface protective layer 15 is less than 0.1 μm, the surface protective layer 15 does not substantially develop its function, the charge transport layer 13 is exposed earlier when used repeatedly and the wear resistance cannot be improved. If the layer thickness of the surface protective layer 15 is higher than 10 μm, this is undesirable because the charge transfer speed in the surface protective layer is low and is rate-determining, bringing about a fear as to a reduction in the sensitivity of the photoconductor 10.

As a method of applying a coating solution in the formation of the surface protective layer 15, any of a dip coating method, spraying method, bar coating method, roll coating method, blade method and ring method may be used. However, because a polymerization reaction of the coating solution gradually proceeds during storing, a spraying method, bar coating method, roll coating method, blade method or ring method which is applicable even in a small amount is more desirable than a dip coating method requiring a large stock of the coating solution.

Examples of the solvent used in the coating solution of the surface protective layer 15 may include aromatic hydrocarbons such as benzene, toluene, xylene and monochlorobenzene, hydrocarbon halides such as dichloromethane and dichloroethane, ethers such as tetrahydrofuran, dioxane and dimethoxymethyl ether and aprotic polar solvents such as N,N-dimethylformamide. Among these solvents, low-boiling point solvents such as acetone and tetrahydrofuran are preferably used from the viewpoint of preventing the dissolution of the charge transport layer.

Also, the curing reaction of the coating film obtained by applying the above coating solution is conducted by irradiating the coating layer with light in an apparatus provided with a device, such as a high-pressure mercury lamp or metal halide lamp, for applying light having a wavelength including the absorption wavelength of the amine compound of the formula (1).

Embodiment 2

Figure 2:
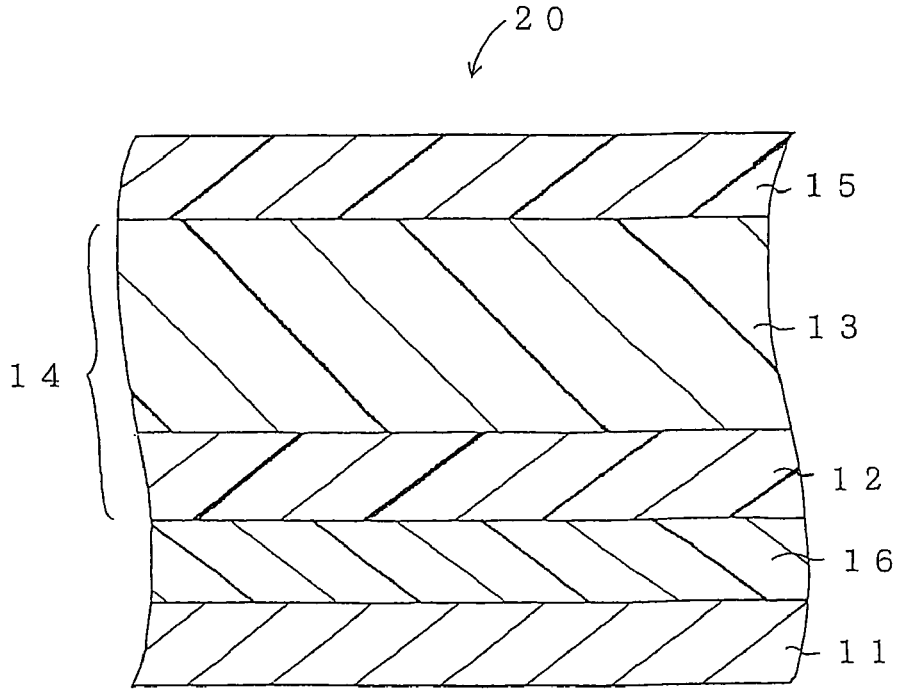
FIG. 2 is a partial sectional view simply showing the structure of an embodiment 2 of an electrophotographic photoconductor according to the present invention.

FIG. 2 is a partial sectional view simply showing the structure of an embodiment 2 of the electrophotographic photoconductor of the present invention. The electrophotographic photoconductor 20 of the embodiment 2 is different from the electrophotographic photoconductor 10 of the embodiment 1 in the point that an intermediate layer 16 is disposed between the conductive support 11 and the light-sensitive layer (laminate type photoconductive layer) 14. Other structures in this embodiment 2 are the same as those in the embodiment 1. Therefore, the same elements are represented by the same symbols and the explanations of these elements are not repeated here.

The role of the intermediate layer 16 will be explained.

In the case where the intermediate layer 16 is not formed between the conductive support 11 and the light-sensitive layer 14, there is the case where charges are injected into the light-sensitive layer 14 from the conductive support 11, the electrostatic property of the photoconductor 20 is reduced, the surface charge of a part other than the part to be erased is reduced by exposure to light and image defects such as fogging are caused. When an image is formed using a reverse developing process in particular, a toner tends to easily adhere to the part decreased in surface charge by exposure to light. Therefore if the surface charge is reduced by a cause other than exposure to light, image fogging called "black dot" which is a phenomenon that a toner adheres to a white background to form small black points and there is therefore a fear as to a significant deterioration in image quality. When the intermediate layer 16 is not present between the conductive support 11 and the light-sensitive layer 14, there is the possibility that a reduction in electrostatic property in a microregion is caused by the defects of the conductive support 11 or light-sensitive layer 14, giving rise to image fogging such as the black dots, causing a large image defect as mentioned above.

Because the intermediate layer 16 is disposed between the conductive support 11 and the light-sensitive layer 14 in the photoconductor 20 of this embodiment 2 as mentioned above, it is possible to prevent charges from being injected into the light-sensitive layer 14 from the conductive support 11. Therefore, a reduction in the electrostatic property of the photoconductor 20 can be prevented, a reduction in surface charges in a part other than the exposed part is suppressed and it is therefore possible to prevent the occurrence of image defects such as fogging. Moreover, surface defects of the conductive support 11 is covered with the intermediate layer 16 and it is therefore possible to obtain a uniform surface, so that the film forming characteristics of the light-sensitive layer 14 can be improved. Also, the intermediate layer 16 functions as an adhesive binding the conductive support 11 with the light-sensitive layer 14 and it is therefore possible to prevent the light-sensitive layer 14 from being peeled from the conductive support 11.

As the intermediate layer 16, for example, a resin layer constituted of various resin materials or an alumite layer is used. Examples of the resin material constituting the resin layer used in the intermediate layer 16 may include resins such as a polyethylene resin, polypropylene resin, polystyrene resin, acryl resin, vinyl chloride resin, vinyl acetate resin, polyurethane resin, epoxy resin, polyester resin, melamine resin, silicone resin, polyvinylbutyral resin and polyamide resin and copolymer resins containing two or more repeat units constituting these resins. Also, casein, gelatin, polyvinyl alcohol, ethyl cellulose and the like are given as examples. Among these resins, a polyamide resin is preferably used and particularly an alcohol-soluble nylon resin is preferably used. Examples of the alcohol-soluble nylon resin may include copolymer nylon obtained by copolymerizing 6-nylon, 6,6-nylon, 6,10-nylon, 11-nylon or 12-nylon and resins such as N-alkoxymethyl-modified nylon and N-alkoxyethyl-modified nylon obtained by chemically modifying polyamides.

The intermediate layer 16 preferably contains particles such as metal oxide particles. If these particles are compounded in the intermediate layer 16, the volume resistance of the intermediate layer 16 can be controlled, the injection of charges into the light-sensitive layer 14 from the conductive support 11 can be prevented more exactly. Also, the electric properties of the photoconductor 20 is maintained under various environments and the environmental stability can be improved. Examples of the metal oxide particles may include particles of titanium oxide, aluminum oxide, aluminum hydroxide or tin oxide.

The intermediate layer 16 is formed as follows: the aforementioned resin and, according to the need, the aforementioned metal oxide particles are dissolved and/or dispersed in a proper solvent to prepare an intermediate layer coating solution and this coating solution is then applied to the surface of the conductive support 11.

As the solvent of the intermediate layer coating solution, water or various organic solvents, or mixture solvents of these solvents are used. Among these solvents, a single solvent selected from water, methanol, ethanol, butanol and the like or a mixture solvent of water and alcohols, two or more alcohols, acetone or dioxorane and alcohols or chlorine type solvents such as dichloroethane, chloroform or trichloroethane and alcohols is preferable. A non-halogen type organic solvent is preferably used in consideration of, particularly, global atmosphere.

As a method of dispersing the aforementioned particles such as metal oxide particles in a solvent, known dispersing methods using a ball mill, sand mill, attritor, oscillation mill, ultrasonic dispersing machine or paint shaker may be used.

In the intermediate layer coating solution, the ratio C/D of the total weight C of the resin and the metal oxide to the weight D of the solvent used in the intermediate layer coating solution is preferably 1/99 to 40/60 (about 0.01 to about 0.67) and more preferably 2/98 to 30/70 (about 0.02 to about 0.43). The ratio E/F of the weight E of the resin to the weight F of the metal oxide is preferably 90/10 to 1/99 (9 to about 0.01) and more preferably 70/30 to 5/95 (about 2.33 to about 0.05).

Examples of a coating method of the intermediate layer coating solution may include a spraying method, bar coating method, roll coating method, blade method, ring method and dip coating method. Among these coating methods, particularly the dip coating method is relatively simple and also superior in productivity and cost as mentioned above and is therefore also used in the case of forming the intermediate layer 16.

The layer thickness of the intermediate layer 16 is preferably 0.01 to 20 μm and more preferably 0.05 to 10 μm. If the layer thickness of the intermediate layer 16 is less than 0.01 μm, there is the possibility that the intermediate layer 16 does not substantially develop its function, it fails to cover the defects of the conductive support 11, so that uniform surface characteristics cannot be obtained, the injection of charges into the light-sensitive layer 14 from the conductive support 11 cannot be prevented and there is a fear that the electrostatic property of the photoconductor 20 is dropped. If the layer thickness of the intermediate layer 16 is designed to be higher than 20 μm, this is not preferable because when the intermediate layer 16 is formed by a dip coating method, there is a fear that it is difficult to form the intermediate layer 16 and the light-sensitive layer 14 cannot be uniformly formed on the intermediate layer 16, with the result that the sensitivity of the photoconductor 20 is reduced.

Embodiment 3

Figure 3:
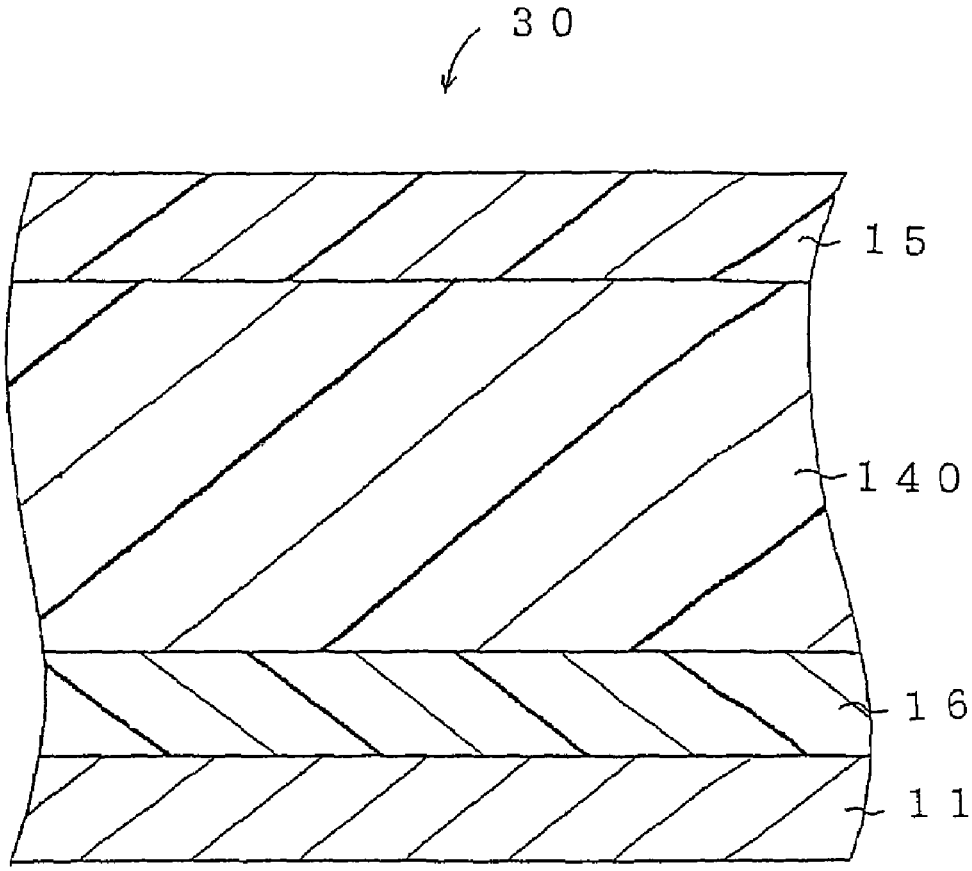
FIG. 3 is a partial sectional view simply showing the structure of an embodiment 3 of an electrophotographic photoconductor according to the present invention.

FIG. 3 is a partial sectional view simply showing the structure of an embodiment 3 of the electrophotographic photoconductor of the present invention. The electrophotographic photoconductor 30 of the embodiment 3 is different from the electrophotographic photoconductor 20 of the embodiment 2 in the point that a light-sensitive layer (single layer type photoconductive layer) 140 having a single layer containing both the charge generation material and the charge transport material is disposed on the intermediate layer 16. Other structures in this embodiment 3 are the same as those in the embodiment 2. Therefore, the same elements are represented by the same symbols and the explanations of these elements are not repeated here.

The single layer type photoconductor 30 of this embodiment 3 is suitable for a photoconductor for a positive charge type image forming apparatus reduced in the generation of ozone. Also, because the light-sensitive layer 140 is a single layer in the single layer type photoconductor 30 of this embodiment 3, it is superior in production cost and yield to the laminate type photoconductor 20 of this embodiment 2.

The light-sensitive layer 140 may be formed by using a binder resin to bind the aforementioned charge generating material with the aforementioned charge transport material. As the binder resin, for example, those exemplified as the binder resin for the charge transport layer 13 in the embodiment 1 may be used. The ratio $A_1/B_1$ of the weight $A_1$ of the charge transport material to the weight $B_1$ of the binder resin in the light-sensitive layer 140 is preferably 10/12 to 10/30 (about 0.83 to about 0.33) like the ratio A/B of the weight A of the charge transport material to the weight B of the binder resin of the charge transport layer 13 in the embodiment 1.

Like the charge transport layer 13 in the embodiment 1, various additives such as a plasticizer, leveling agent, microparticles of an inorganic compound or organic compound and sensitizers such as an electron receiving material and dyes may be added in the light-sensitive layer 140.

The light-sensitive layer 140 may be formed in the same method as the charge transport layer 13 in the embodiment 1. For example, the above charge generating material, a charge transport material, a binder resin and various additives are added in a proper solvent such as the solvent to be used in the aforementioned charge transport layer coating solution and are dissolved and/or dispersed to prepare a photoconductive layer coating solution. Then, this coating solution is applied to the surface of the intermediate layer 16 by, for example, a dip coating method, whereby the light-sensitive layer 140 can be formed.

The layer thickness of the light-sensitive layer 140 is preferably 5 to 100 μm and more preferably 10 to 50 μm. When the layer thickness of the light-sensitive layer 140 is less than 5 μm, there is a fear that the charge retentivity of the surface of the photoconductor is deteriorated. When the layer thickness of the light-sensitive layer 140 exceeds 100 μm, there is the possibility of low productivity.

Next, an image forming apparatus provided with any one of the electrophotographic photoconductors of the above embodiments 1 to 3 according to the present invention will be explained. The image forming apparatus of the present invention is not limited to the following descriptions.

FIG. 4 is an arrangement side view simply showing the structure of an image forming apparatus 100 that is an embodiment of the image forming apparatus of the present invention. The image forming apparatus 100 shown in FIG. 4 is mounted with a cylindrical photoconductor 7 having the same layer structure as the photoconductor 10 in the embodiment 1 shown in the above FIG. 1. The structure and image forming action of the image forming apparatus 100 will be explained with reference to FIG. 4.

The image forming apparatus 100 is provided with the aforementioned photoconductor 7 supported by the apparatus (not shown) of the device in a rotatable manner and a driving means (not shown) that rotates the photoconductor 7 in the direction of the arrow 41 around a rotation axis 44. The driving means is provided with, for example, a motor as a power source and conducts the power of the motor to the support constituting the core of the photoconductor 7 through a gear (not shown) to thereby rotate the photoconductor 7 at a specified peripheral speed.

Around the photoconductor 7, a charger 32, an exposing means, a developing unit 33, a transfer unit 34, a cleaner 36 and a charge erasing lamp (not shown) are disposed in this order from the upstream side to the downstream side in the direction of the rotation of the photoconductor 7 as shown by the arrow 41.

The charger 32 is a charging means that electrize the surface 43 of the photoconductor 7 at a specified potential. The charger 32 is a non-contact type charging means such as a corona charger.

The exposing means 30 is provided with, for example, a semiconductor laser as a light source and exposes the charged surface 43 of the photoconductor 7 to a light 31 from a laser beam output corresponding to the image information from the light source to thereby form an electrostatic latent image on the surface 43 of the photoconductor 7.

The developing unit 33 is a developing means that develops the electrostatic latent image formed on the surface 43 of the photoconductor 7 to form a toner image which is a visual image, and is provided with a developing roller **33*a* that supplies a toner to the surface 43 of the photoconductor 7 and is disposed opposite to the photoconductor 7 and a casing 33*b* that supports the developing roller 33*a* in a rotatable manner around a rotation axis parallel to the rotation axis 44 of the photoconductor 7** and contains a developer containing a toner in its inside space.

The transfer unit 34 is a transfer means that transfers the toner image formed on the surface 43 of the photoconductor 7 to a recording paper 51 that is a transfer material from the surface 43 of the photoconductor 7. The transfer unit 34 is a non-contact type transfer means that is provided with a charging means such as a corona charger and provides charges having polarities opposite to those of the toner to the recording paper 51 to thereby transfer the toner image to the recording paper 51.

The cleaner 36, which is a cleaning means that cleans the surface of the photoconductor 7 after the toner image is transferred, is pressed against the surface 43 of the photoconductor. The cleaner 36 is provided with a cleaning blade **36*a* that separates the toner remaining on the surface 43 of the photoconductor 7 from the above surface 43 after the transfer operation of the transfer unit 34, and a recovery casing 36*b* receiving the toner separated by the cleaning blade 36*a***.

Also, a fixing unit 35, which is a fixing means for fixing the transferred toner image, is disposed at a place in the direction in which the recording paper 51 is conveyed after it is allowed to pass through the space between the photoconductor 7 and the transfer unit 34. The fixing unit 35 is provided with a heating roller **35*a* having with a heating means (not shown) and a pressure roller 35*b* that is disposed opposite to the heating roller 35*a* and presses in combination with the heating roller 35*a* to sandwich the recording paper 51**.

Next, the image formation operation of the image forming apparatus 100 will be explained. First, the photoconductor 7 is rotated in the direction of the arrow 41 by a driving means in response to the order from a control section (not shown) and the surface 43 is positively or negatively charged uniformly at a specified potential by the charger 32 disposed on the upstream side of the convergence point of the light 31 of the exposing means 30 in the direction of the rotation of the photoconductor 7.

Then, in response to the order from the control section, the light 31 is irradiated to the surface 43 of the charged photoconductor 7 from the exposing means 30. The light 31 from the light source is scanned repeatedly in the longitudinal direction of the photoconductor 7 which is the major scanning direction, corresponding to image information. The surface 43 of the photoconductor 7 can be exposed to light corresponding to the image information by rotating the photoconductor 7 and by scanning the light 31 from the light source based on the image information. By this exposing operation, the surface charge of the part irradiated with the light 31 drops, causing a difference in surface potential between the part which is irradiated with the light 31 and the part which is not irradiated with the light 31, whereby an electrostatic latent image is formed on the surface 43 of the photoconductor 7. Also, the recording paper 51 is fed to the transfer position between the transfer unit 34 and the photoconductor 7 from the direction of the arrow 42 by a conveying means (not shown) synchronously with the exposure of the photoconductor 7 to light.

Then, a toner is fed to the surface 43 of the photoconductor 7 on which the electrostatic latent image is formed from the developing roller 33*a* of the developing unit 33 disposed on the downstream side of the convergence point of the light 31 from the light source in the direction of the rotation of the photoconductor 7. The electrostatic latent image is thereby developed to form a toner image as a visual image on the surface 43 of the photoconductor 7. When the recording paper 51 is fed between the photoconductor 7 and the transfer unit 34, charges having polarity opposite to that of the toner are provided to the recording paper 51, whereby the toner image formed on the surface 43 of the photoconductor 7 is transferred to the recording paper 51.

The recording paper 51 to which the toner image is transferred is conveyed to the fixing unit 35 by a conveying means and heated and pressurized when it is allowed to pass through the place between the heating roller 35*a* and the pressure roller 35*b*. The toner image on the recording paper 51 is thereby fixed to the recording paper 51 to form a fast image. The recording paper 51 on which an image is formed in this manner is discharged out of the image forming apparatus 100 by a conveying means.

On the other hand, the surface 43 of the photoconductor 7, which is further rotated in the direction of the arrow 41 after the toner image is transferred to the recording paper 51, is subjected to scrape and clean by means of a cleaning blade 36*a* of the cleaner 36. The surface 43 of the photoconductor 7 from which the toner is removed in this manner is exposed to the light from the charge erasing lamp (not shown) to remove the charges of the surface, whereby the electrostatic latent image on the surface 43 of the light-sensitive 7 is erased. After that, the photoconductor 7 is further rotated and a series of operations starting again from the charging of the photoconductor 7 is repeated. In the above manner, an image is formed continuously.

The photoconductor 7 to be mounted on the image forming apparatus 100 contains the amine compound represented by the formula (1) in the surface protective layer, and is therefore superior in electric properties such as electrostatic property, sensitivity and response and also in wear resistance and oxidizing gas resistance and is not deteriorated in the above excellent electric properties when it is used repeatedly, showing that it has excellent electric durability. Therefore, a highly reliable image forming apparatus 100 capable of forming a high quality image stably for a long period of time is attained.

The structure of the image forming apparatus of the present invention is not limited to the structure of the image forming apparatus 100 shown in FIG. 4 but may be other different structures insofar as the photoconductor of the present invention can be used.

Although, in the image forming apparatus 100 of this embodiment, the charger 32 is, for example, a non-contact type charging means, it is not limited to this type but may be a contact-type charging means such as a charge roller. Also, although the transfer unit 34 is a non-contact type transfer means that transfers without using pressing force, it is not limited to this type but may be a contact-type transfer means that transfers by utilizing pressing force. As the contact type transfer means, a transfer means may be used that is provided with, for example, a transfer roller, which works as follows. Specifically, it is pressed against the photoconductor 7 from the surface of the recording paper 51 on the side opposite to the surface which is in contact with the surface 43 of the photoconductor 7, to apply voltage to the transfer roller in the situation where the photoconductor 7 is in pressed contact with the recording paper 51 to transfer the toner image on the recording paper 51.

EXAMPLES

Next, the present invention will be explained in more detail by way of examples and comparative examples. However, the present invention is not limited to the following descriptions.

First, explanations will be furnished as to photoconductors that were prepared as examples and comparative examples by forming a light-sensitive layer on an aluminum cylindrical conductive support having an outside diameter of 40 mm and a length of 340 mm in the longitudinal direction in various conditions.

Example 1

7 parts by weight of titanium oxide (trade name: TT055A, manufactured by Ishihara Sangyo Co., Ltd.) and 13 parts by weight of a copolymer nylon resin (trade name: CM8000, manufactured by Toray Industries, Inc.) were added to a mixture solvent of 159 parts by weight of methanol and 106 parts by weight of 1,3-dioxorane and the mixture was subjected to dispersing treatment using a paint shaker for 8 hours to prepare an intermediate layer coating solution. This coating solution was filled in a coating vessel and the conductive support was dipped in the coating solution and was then pulled up, followed by natural drying to form an intermediate layer having a layer thickness of 1 μm on the conductive support.

Then, 2 parts by weight of a crystal type oxotitanium phthalocyanine crystal showing a clear diffraction peak at least at a Bragg angle 2θ of (error: 2θ±0.2°) of 27.2° in an X-ray diffraction spectrum of Cu-Kα characteristic X-ray (wavelength: 0.154 nm (1.54 Å) as a charge generating material, 1 part by weight of a polyvinylbutyral resin (trade name: S-LEC BM-2, manufactured by Sekisui Chemical Co., Ltd.) and 97 parts by weight of methyl ethyl ketone were mixed and dispersed by a paint shaker to prepare a charge generation layer coating solution. This coating solution was applied to the intermediate layer by the same dip coating method that was used in the case of the intermediate layer formed previously, followed by natural drying to form a charge generation layer having a layer thickness of 0.4 μm. In the present invention, the Bragg angle 2θ means the angle at which the incident X-ray and the diffraction X-ray cross and represents an angle of diffraction.

Then, 5 parts by weight of a charge transport material represented by the following compound (2) as a charge transport material and 8 parts by weight of a polycarbonate resin (trade name: lupilon Z400, manufactured by Mitsubishi Gas Chemical Company Inc.) as a binder resin were mixed and 47 parts by weight of tetrahydrofuran was used as a solvent, to prepare a charge transport layer coating solution. This coating solution was applied to the charge generation layer formed previously, by the same dip coating method that was used in the case of the intermediate layer and dried at 120° C. for 1 hour to form a charge transport layer having a layer thickness of 22 μm.

(2)

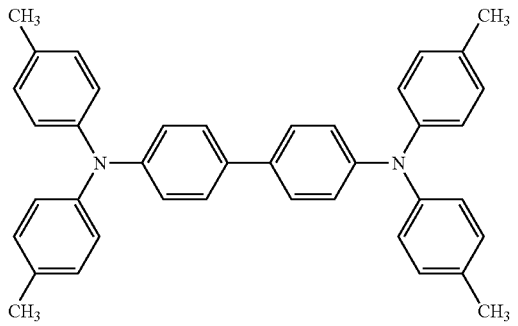

Next, 80 parts by weight of trimethylolpropane triacrylate (trade name: KAYARAD TMPTA, manufactured by Nippon Kayaku Co., Ltd.) as a trifunctional radical polymerizable monomer, 15 parts by weight of an amine compound (trade name: IRGACURE 369, manufactured by Ciba Specialty Chemicals Inc.) which was the exemplified compound No. 14 shown in the above Table 2 as a photoinitiator and 5 parts by weight of a charge transport material represented by the above structural formula (2) as a charge transport material were dissolved in 400 parts by weight of tetrahydrofuran to prepare a surface protective layer coating solution.

This surface protective layer coating solution was applied to the charge transport layer by spraying coating and irradiated with light from a metal halide lamp in the condition of an intensity of 600 mW/cm$^2$ and irradiation time of 100 seconds to run a crosslinking reaction, thereby forming a surface protective layer 4.0 μm in thickness.

A photoconductor of Example 1 was manufactured in the above manner.

The residual amount of the photoinitiator (amine compound) contained in the surface protective layer was confirmed in the following method. Specifically, when the produced photoconductor is dipped in tetrahydrofuran, the charge transport layer is dissolved, but the surface protective layer is peeled because it is cured and precipitates as an insoluble substance. The photoinitiator, the charge transfer agent and the binder resin are dissolved in the solution. Based on the above point, the photoinitiator was separated by refining using a column and the weight of the photoinitiator was measured to find the ratio of the photoinitiator based on the total weight of the insoluble component and the initiator as the solid weight.

Example 2

A photoconductor of Example 2 was manufactured in the same manner as in Example 1 except that the exemplified compound No. 2 shown in Table 1 was used in place of the exemplified compound No. 14 when the surface protective layer was formed.

Example 3

A photoconductor of Example 3 was manufactured in the same manner as in Example 1 except that the exemplified compound No. 7 shown in Table 1 was used in place of the exemplified compound No. 14 when the surface protective layer was formed.

Example 4

A photoconductor of Example 4 was manufactured in the same manner as in Example 1 except that the amount of the monomer was altered to 83 parts by weight and the amount of the exemplified compound No. 14 as the photoinitiator was altered to 12 parts by weight when the surface protective layer was formed.

Example 5

A photoconductor of Example 5 was manufactured in the same manner as in Example 1 except that the amount of the monomer was altered to 77 parts by weight and the amount of the exemplified compound No. 14 as the photoinitiator was altered to 18 parts by weight when the surface protective layer was formed.

Example 6

A photoconductor of Example 6 was manufactured in the same manner as in Example 1 except that the amount of the monomer was altered to 82 parts by weight, the amount of the exemplified compound No. 14 as the photoinitiator was altered to 18 parts by weight, and the charge transport material was not used when the surface protective layer was formed.

Example 7

A photoconductor of Example 7 was manufactured in the same manner as in Example 1 except that the amount of the monomer was altered to 75 parts by weight, the amount of the exemplified compound No. 14 as the photoinitiator was altered to 15 parts by weight, and 5 parts by weight of silica microparticles having a particle diameter of 0.05 μm was used as a filler when the surface protective layer was formed.

Example 8

A photoconductor of Example 8 was manufactured in the same manner as in Example 1 except that the amount of the monomer was altered to 89 parts by weight and the amount of the exemplified compound No. 14 as the photoinitiator was altered to 6 parts by weight when the surface protective layer was formed.

Example 9

A photoconductor of Example 9 was manufactured in the same manner as in Example 1 except that the amount of the monomer was altered to 70 parts by weight and the amount of the exemplified compound No. 14 as the photoinitiator was altered to 25 parts by weight when the surface protective layer was formed.

Comparative Example 1

A photoconductor of Comparative Example 1 was manufactured in the same manner as in Example 1 except that no surface protective layer was formed.

Comparative Example 2

A photoconductor of Comparative Example 2 was manufactured in the same manner as in Example 1 except that a comparative compound (3) (trade name: IRGACURE 651, manufactured by Ciba Specialty Chemicals Inc.) having the following structure was used in place of the exemplified compound No. 14 when the surface protective layer was formed.

(3)

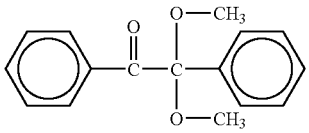

Comparative Example 3

A photoconductor of Comparative Example 3 was manufactured in the same manner as in Example 1 except that a comparative compound (4) (trade name: IRGACURE 184, manufactured by Ciba Specialty Chemicals Inc.) having the following structure was used in place of the exemplified compound No. 14 when the surface protective layer was formed.

(4)

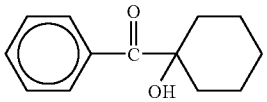

Each photoconductor of Examples 1 to 9 and Comparative Examples 1 to 3 manufactured in the above manner was fitted to a commercially available digital copying machine (trade name: AR-C280, manufactured by Sharp Corporation) provided with a corona charger as a charging means for the photoconductor. The developing unit was dismounted from this digital copying machine and a surface potentiometer (trade name: MODEL 344, manufactured by Treck) was fitted to the developing part instead of the developing unit so as to be able to measure the surface potential of the photoconductor during the course of the formation of an image, to remodel the copying machine into an evaluating device for evaluating initial electric properties and electrical durability. The digital copying machine (trade name: AR-C280, manufactured by Sharp Corporation) before remodeled is a negative charge type image forming apparatus which forms an image by using a reverse developing process carried out by negatively charging the surface of the photoconductor.

The above evaluating device was used to measure the surface potentials of the photoconductor at a temperature of 25° C. under a relative humidity of 20% when the photoconductor is exposed and not exposed to laser light as charge potentials V0 (V) and exposed potential VL (V) respectively. The above results of measurement were defined as the evaluation index of the initial electric properties. The initial electric properties were rated as follows: the electrostatic property is more excellent as the absolute value of the charge potential V0 is increased and the response is more excellent as the absolute value of the exposed potential VL is decreased.

Next, the surface potentiometer was dismounted from the above evaluating device and the developing unit was again mounted on and fitted to the copying machine. This copying machine was used to print a test image having a specified pattern on each of 100000 recording sheets. After 100000 copies were printed by the copying machine, the developing unit was again dismounted and the aforementioned surface potentiometer was fitted to the developing part to restore the copying machine to the remodeled evaluating device, thereafter measuring the charge potential V0 (V) and the exposed potential VL (V) respectively in the same manner as in the case of the initial stage.

Also, the mounted photoconductor was taken out to measure the film thickness d1 of the light-sensitive layer to find a difference between this value (d1) and the film thickness d0 of the light-sensitive layer just after it was produced as an abraded film thickness Δd (=d0−d1).

Here, the film thickness was measured using a film thickness measuring system (trade name: MCPD-1100, Otsuka Electronics Co., Ltd.).

The results of the above evaluation are shown in Table 6 and 7.

TABLE 6

| | Surface protective layer | | Initial | | After 100000 sheets are printed | | Abraded film |
|---|---|---|---|---|---|---|---|
| | Initiator | Additive | | | | | |
| | Amount in the total solid (wt %) | Amount in the total solid (wt %) | V0 (−V) | VL (−V) | V0 (−V) | VL (−V) | thickness (μm) |
| Example 1 | No. 14 15 | Charge transfer material 5 | 530 | 75 | 525 | 90 | 2.5 |
| Example 2 | No. 2 15 | Charge transfer material 5 | 535 | 70 | 520 | 85 | 2.7 |
| Example 3 | No. 7 15 | Charge transfer material 5 | 535 | 80 | 530 | 95 | 2.3 |
| Example 4 | No. 14 12 | Charge transfer material 5 | 530 | 70 | 525 | 100 | 2.1 |
| Example 5 | No. 14 18 | Charge transfer material 5 | 530 | 75 | 530 | 90 | 2.6 |
| Example 6 | No. 14 18 | None 0 | 540 | 70 | 530 | 110 | 2.3 |
| Example 7 | No. 14 | Charge transfer material/filler | 530 | 75 | 530 | 95 | 1.7 |

TABLE 7

| | Surface protective layer | | | | After 100000 | | |
|---|---|---|---|---|---|---|---|
| | Initiator Amount in the | Additive Amount in the | Initial | | sheets are printed | | Abraded film |
| | total solid (wt %) | total solid (wt %) | V0 (−V) | VL (−V) | V0 (−V) | VL (−V) | thickness (μm) |
| | 15 | 5/5 | | | | | |
| Example 8 | No. 14 | Charge transfer material | 530 | 75 | 550 | 170 | 2.1 |
| | 6 | 5 | | | | | |
| Example 9 | No. 14 | Charge transfer material | 530 | 75 | 450 | 90 | 6.3 |
| | 25 | 5 | | | | | |
| Comparative Example 1 | — | — | 540 | 70 | 420 | 95 | 10.5 |
| | — | — | | | | | |
| Comparative Example 2 | Comparative compound 1 | Charge transfer material | 530 | 85 | 560 | 250 | 2.7 |
| | 15 | 5 | | | | | |
| Comparative Example 3 | Comparative compound 2 | Charge transfer material | 530 | 80 | 550 | 240 | 2.5 |
| | 15 | 5 | | | | | |

It is found that Examples 1 to 7 all exhibit better electric properties and are also superior in wear resistance.

Example 8 is superior in wear resistance but is deteriorated in electric characteristics after the photoconductor is used repeatedly though it has good electric properties in the initial stage. Example 9 has good electric properties but is slightly inferior in the wear resistance to Examples which are reduced in the amount of the amine compound of the present invention.

On the other hand, in the case of disposing no surface protective layer like Comparative Example 1, it is found that the charge transport layer is significantly abraded and the photoconductor has poor durability.

Also, in the case of using a photoinitiator other than the photoinitiator of the present invention like Comparative Examples 2 and 3, it is found that the electric properties are significantly deteriorated.

As mentioned above, the amine compound of the formula (1) as the initiator is added to the surface protective layer forming materials and this amine compound is made to remain in the surface protective layer after polymerization is completed, which makes it possible to obtain an electrophotographic photoconductor which is superior in electric properties such as wear resistance, electrostatic property, sensitivity and response, is also superior in oxidizing gas resistance such as ozone resistance and nitrogen oxide resistance and is also superior in electric durability because prevents the aforementioned good electric properties from being deteriorated even if the photoconductor is repeatedly used.

The electrophotographic photoconductor of the present invention is applied to copying machines and printers or the like which are output means in computers and the like.

What is claimed is:

1. An electrophotographic photoconductor comprising:

an conductive support;

a light-sensitive layer formed on the conductive support and containing a charge generating material and a charge transport material; and a surface protective layer formed on the light-sensitive layer and made of an acryl type polymer resin composition, wherein the resin composition constituting the surface protective layer contains an amine compound represented by the following formula (1):

(1)

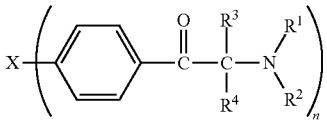

wherein $R^1$ and $R^2$ are, the same or different, each an alkyl group or an allyl group which may have a substituent or a heterocyclic residue to be formed through or not through a nitrogen atom or an oxygen atom together with the nitrogen atom to which $R^1$ and $R^2$ are bonded, $R^3$ and $R^4$ are, the same or different, each an alkyl group having a substituent and n denotes 1 or 2, provided that when n is 1, X is a hydrogen atom, a halogen atom, or an alkyl group, a hydroxyl group or a mercapto group which may have a substituent, or a ring optionally containing an oxygen atom and a nitrogen atom between carbon atoms and when n is 2, X is an oxygen atom or a sulfur atom, said amine compound having initiated photopolymerization of the acryl type polymer resin composition.

2. The electrophotographic photoconductor according to claim 1, wherein, in the above formula (1);

when n is 1;

X is a hydrogen atom, a halogen atom, a lower alkyl group, a hydroxyl group which may be substituted with a phenyl group or a lower alkyl group, a mercapto group which may be substituted with a phenyl group or a lower alkyl group or a morpholino group;

$R^1$ and $R^2$ are, the same or different, each a lower alkyl group which may be substituted with a phenyl group or a lower alkoxy group, allyl group or a piperidino group, a morpholino group or piperazinyl group formed in combination with the nitrogen atom to which $R^1$ and $R^2$ are bonded wherein the nitrogen atom in the piperazinyl group may be substituted with a lower alkyl group;

$R^3$ and $R^4$ are, the same or different, each a lower alkyl group which may be substituted with a phenyl group or an alkoxycarbonyl group; or:

when n is 2;

X represents an oxygen atom or a sulfur atom;

$R^1$ and $R^2$ are, the same or different, each a lower alkyl group; and $R^3$ and $R^4$ are, the same or different, each a lower alkyl group which may be substituted with a phenyl group.

3. The electrophotographic photoconductor according to claim 1, wherein, in the above formula (1);

when n is 1;

$R^3$ and $R^4$ are, the same or different, each an alkyl group which has 1 to 8 carbon atoms and optionally contains a phenyl group or an alkoxycarbonyl group having 2 to 5 carbon atoms as a substituent;

X is a hydrogen atom, a halogen atom, a hydroxyl group, an alkyl group having 1 to 4 carbon atoms, an alkoxy group having 1 to 4 carbon atoms, an alkylthio group having 1 to 4 carbon atoms, a phenylthio group, a phenoxy group or a morpholino group.

4. The electrophotographic photoconductor according to claim 1, wherein, in the above formula (1);

when n is 1;

$R^1$ and $R^2$ are each an alkyl group having 1 to 4 carbon atoms;

$R^3$ and $R^4$ are, the same or different, each an alkyl group which has 1 to 8 carbon atoms and optionally contains a phenyl group or an alkoxycarbonyl group having 2 to 5 carbon atoms as a substituent;

X is a hydrogen atom or a morpholino group.

5. The electrophotographic photoconductor according to claim 1, wherein the amine compound is contained in an amount of 2 to 5% by weight based on the total weight of the surface protective layer.

6. The electrophotographic photoconductor according to claim 1, wherein the surface protective layer further contains a charge transport material.

7. The electrophotographic photoconductor according to claim 1, wherein the surface protective layer further contains fillers.

8. An image forming apparatus comprising the electrophotographic photoconductor as claimed claim 1, a charge means that charges the electrophotographic photoconductor, an exposure means that exposes the charged electrophotographic photoconductor to light and a developing means that develops an electrostatic latent image formed by the exposure means.

* * * * *